US006402097B1

(12) United States Patent
Wu

(10) Patent No.: US 6,402,097 B1
(45) Date of Patent: Jun. 11, 2002

(54) UPPER GOLF BAG CRADLE FOR A GOLF CART

(76) Inventor: David Wu, No. 35-1, Jih-Hsin Street, Tu Cheng City, Taipei Hsien (TW)

( * ) Notice: Subject to any disclaimer, the term of this patent is extended or adjusted under 35 U.S.C. 154(b) by 0 days.

(21) Appl. No.: 09/634,579

(22) Filed: Aug. 8, 2000

(51) Int. Cl.[7] ..... A63B 55/08

(52) U.S. Cl. ..... 248/98; 248/230.8; 248/313

(58) Field of Search ..... 248/98, 218.4, 248/219.2, 219.4, 230.8, 231.51, 229.17, 313, 505, 154

(56) References Cited

U.S. PATENT DOCUMENTS 4,417,372 A * 11/1983 Ronci ..... 24/163 R
4,551,889 A * 11/1985 Narayan et al. ..... 24/196
4,782,425 A * 11/1988 Breidegam ..... 361/212
5,465,930 A * 11/1995 Wu ..... 248/96
5,551,131 A * 9/1996 Anscher ..... 24/614
5,573,211 A * 11/1996 Wu ..... 248/96
5,606,779 A * 3/1997 Lu ..... 24/68 SK
5,779,259 A * 7/1998 Lin ..... 280/623
5,884,370 A * 3/1999 Bergamin ..... 24/715 K
5,887,318 A * 3/1999 Nicoletti ..... 24/71 SK
6,163,941 A * 12/2000 Lai ..... 24/580
6,175,994 B1 * 1/2001 Nicoletti ..... 24/68 SK
6,185,303 B1 * 2/2001 Losey ..... 379/454
6,215,639 B1 * 4/2001 Hee ..... 361/212

* cited by examiner

*Primary Examiner*—Daniel P. Stodola
*Assistant Examiner*—Khoa Tran
(74) *Attorney, Agent, or Firm*—Varndell & Varndell, PLLC

(57) ABSTRACT

An upper golf bag cradle includes a cradle body fastened to the main rod member of a golf cart and adapted to hold a golf bag, and a fastening belt adjustably fastened to two distal ends of the cradle body to hold down a golf bag on the cradle body, the belt having one end inserted into an insertion slot at one end of the cradle body and secured thereto by hook and loop materials, and an opposite end inserted into an insertion slot at an opposite end of the cradle body and locked by a locking lever, the locking lever having a serrated engagement block formed integral with a head at one end thereof and adapted to hold down the fastening belt on a support plate in the cradle body, a guide wall portion adapted to guide the head over an end plate at one end of the cradle body upon rotary motion, a protruded positioning flange adapted for engagement with a protruded flange of the end plate to hold the locking lever in the locking position, and an inwardly extended baffle adapted to guide the suspended tail portion of the fastening belt toward the cradle body after locking of the locking lever.

2 Claims, 7 Drawing Sheets

UPPER GOLF BAG CRADLE FOR A GOLF CART

BACKGROUND AND SUMMARY OF THE INVENTION

The present invention relates to a golf cart, and more specifically to an upper golf bag cradle for a golf cart, which comprises a smoothly arched holding down strip fastened to the cradle body thereof and adapted to hold down a golf bag on the cradle body, and a locking device adapted to lock the smoothly arched holding down strip after installation of the golf bag.

A regular golf cart 6, as shown in FIG. 1, comprises an upper cradle 7 and a lower cradle 8 adapted for holding a golf bag, a first fastening belt 91 provided at the upper cradle 7, and a second fastening belt 92 provided at the lower cradle 8. The first fastening belt 91 is comprised of two belts 900 respectively fastened to the upper cradle 7, and a quick-release lock formed of a plug member 911 and a socket member 912 adapted for securing the free ends of the belts 900 together. This design is not satisfactory in function. One drawback of this design of golf cart is the complicated adjusting procedure of adjusting the length of the first fastening belt 91 subject to the size of the golf bag to be carried. Another drawback of this design of golf cart is that the belts 900 wear quickly with use. Because the belts 900 are made of fabric, they become loosened or permanently deformed after long uses.

The present invention has been accomplished to provide an upper golf bag cradle for golf cart, which eliminates the aforesaid drawbacks. According to one aspect of the present invention, the upper golf bag cradle comprises a cradle body fastened to the main rod member of a golf cart and adapted to hold a golf bag, and a fastening belt adjustably fastened to two distal ends of the cradle body to hold down a golf bag on the cradle body, wherein the belt has one end inserted into an insertion slot at one end of the cradle body and secured thereto by hook and loop materials, and an opposite end inserted into an insertion slot at an opposite end of the cradle body and locked by a locking lever. According to another aspect of the present invention, the locking lever is pivoted to the cradle body at one end, comprising a serrated engagement block formed integral with a head thereof and adapted to hold down the fastening belt on a support plate in the cradle body, a guide wall portion adapted to guide the head over an end plate at one end of the cradle body upon rotary motion, and a protruded positioning flange adapted for engagement with a protruded flange of the end plate to hold the locking lever in the locking position. According to still another aspect of the present invention, the locking lever further comprises an inwardly extended baffle adapted to guide the suspended tail portion of the fastening belt toward the cradle body after locking of the locking lever.

DETAILED DESCRIPTION OF THE PREFERRED EMBODIMENT

Figure 6:
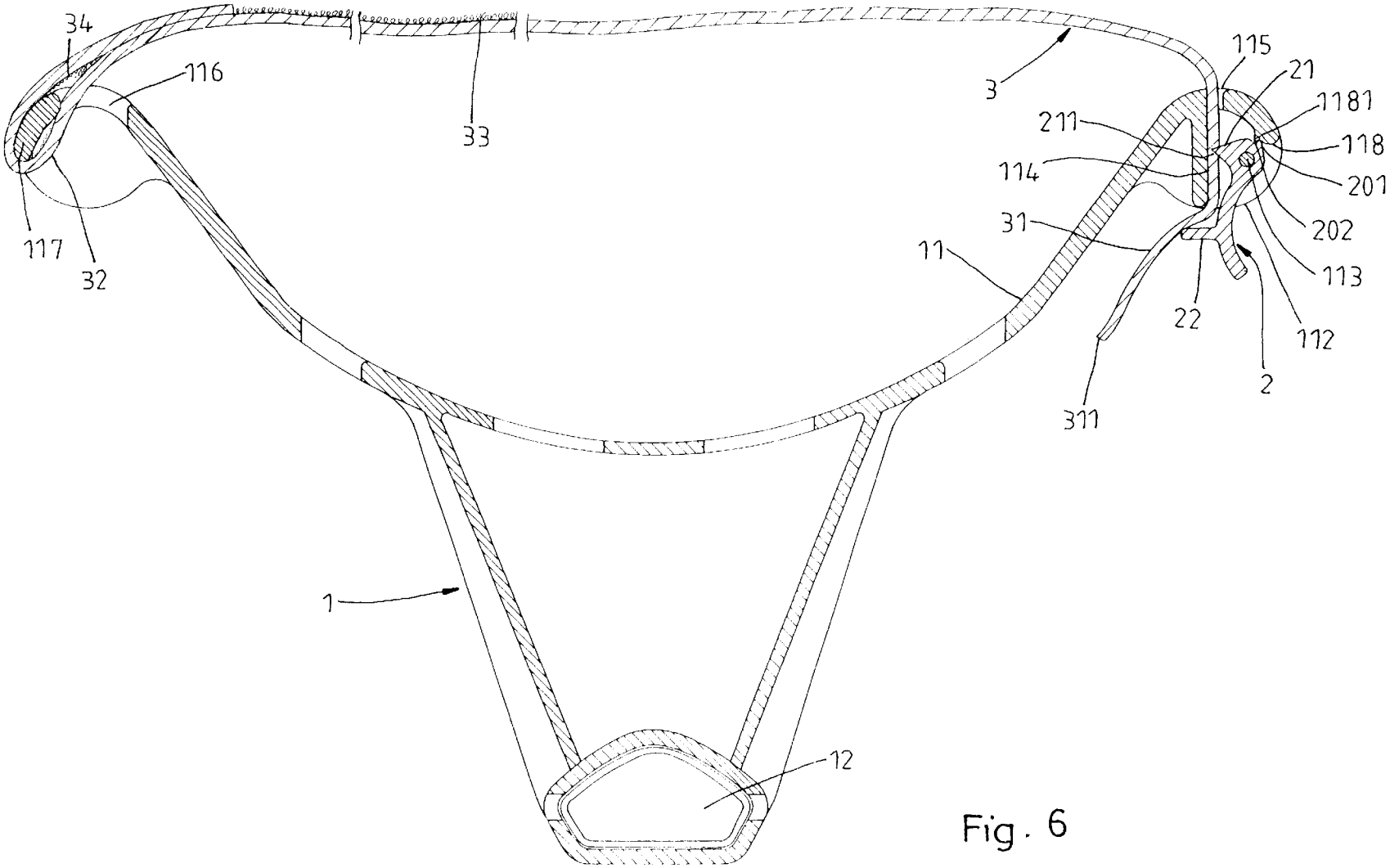
FIG. 6 is similar to FIG. 4 but showing the first end of the fastening belt inserted through the first insertion slot of the cradle body, the locking lever turned to the locking position positioning.
Figure 7:
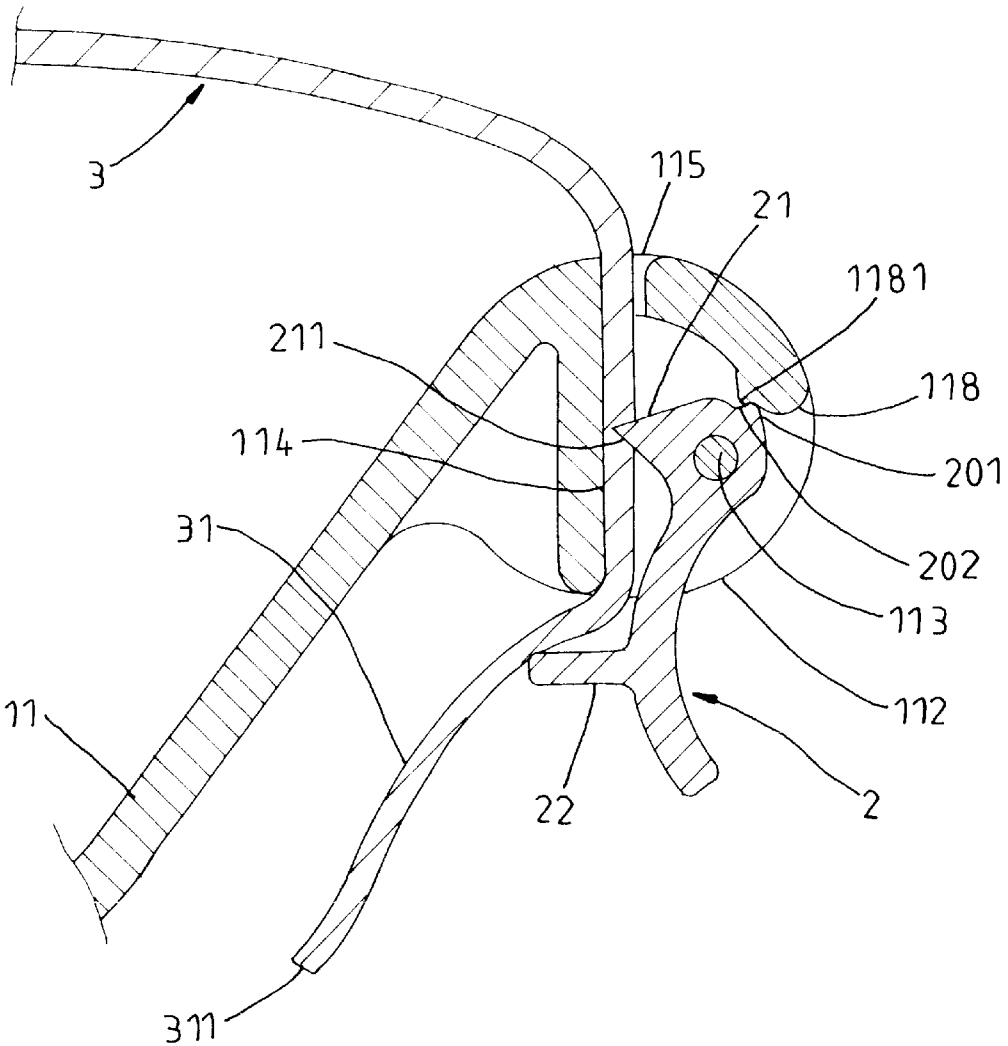
FIG. 7 is in enlarged view of a part of FIG. 6.

Referring to FIGS. from 2 through 7, an upper golf bag cradle for a golf cart in accordance with the present invention comprises a cradle body 1. The cradle body 1 comprises a smoothly arched and inwardly curved top bearing wall 11 adapted to support the golf bag (not shown), a transverse mounting hole 12 (see FIGS. 4 and 5) extended through front and back side walls thereof and adapted to receive the main rod member of the frame structure of a golf cart (not shown) for enabling the cradle body 1 to be fixedly secured to the main rod member of the frame structure of the golf cart by a fastening device. The cradle body 1 further comprises a first insertion slot 115 and a second insertion slot 116 respectively transversely disposed near two distal ends of the smoothly arched and inwardly curved top bearing wall 11, two parallel lugs 111 and 112 formed integral with the front and back side walls and disposed at two distal ends of the first insertion slot 115, a first end plate 118 connected between the lugs 111 and 112 at an outer side of the first insertion slot 115, the first end plate 118 having a protruded flange 1181 transversely disposed at an inner side, a support plate 114 connected between the lugs 111 and 112 at an inner side of the first insertion slot 115 opposite to the support plate 114, and a second end plate 117 disposed at one side of the second insertion slot 116 opposite to the smoothly arched and inwardly curved top bearing wall 11. A fastening belt 3 is adjustably fastened to the cradle body 1, and adapted to hold down the golf bag carried on the smoothly arched and inwardly curved bearing wall 11. The fastening belt 3 has a first end 31 inserted through the first insertion slot 115 of the cradle body 1 and locked by a locking lever 2, and a second end 32 inserted through the second insertion slot 116 of the cradle body 1 and secured to the second end plate 117 by a tape of hook material 33 and a tape of loop material 34. The tape of hook material 33 and the tape of loop material 34 are fastened to the second end 32 of the fastening belt 3 by stitches and longitudinally spaced at a distance. The locking lever 2 is pivotally connected between the lugs 111 and 112 by a pivot 113, comprising a head 20 coupled to the pivot 113, and an engagement block 21 raised from the head 20 and adapted to hold down the first end 31 of the fastening belt 3 against the support plate 114. The engagement block 21 comprises a serrated portion 211 adapted to engage the first end 31 of the fastening belt 3, a guide wall portion 201 adapted to guide the head 20 over the first end plate 118 upon rotary motion of the locking lever 2 about the pivot 113, a protruded positioning flange 202 adapted for engagement with the protruded flange 1181 of the first end plate 118 to hold the locking lever 2 in the locking position (see FIGS. 6 and 7). The locking lever 2 further comprises an inwardly extended baffle 22 adapted to guide the tail 311 of the first end 31 of the fastening belt 3 toward the cradle body 1, preventing the tail 311 of the first end 31 of the fastening belt 3.

Figure 1:
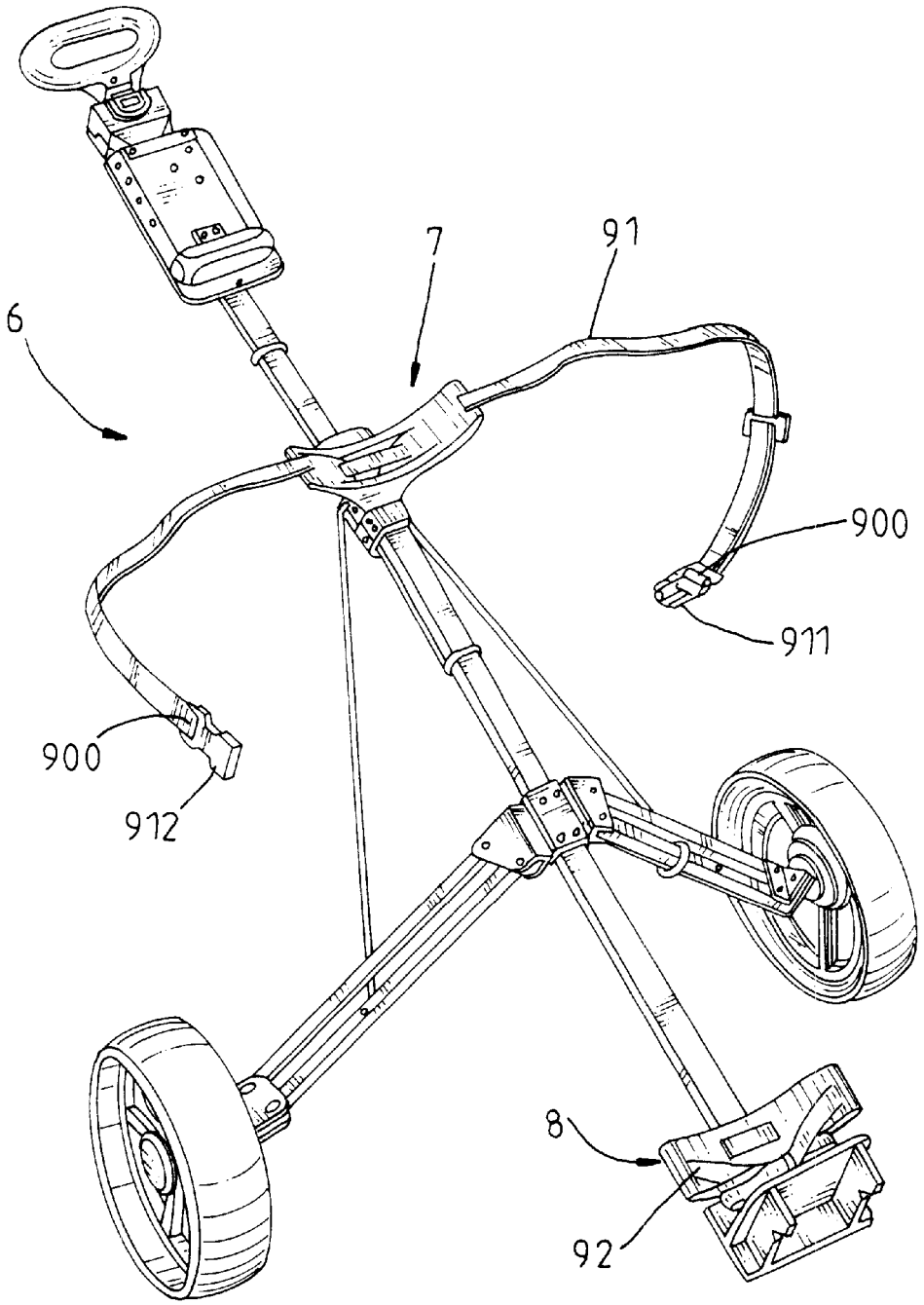
Fig.1 PRIOR ART
FIG. 1 is an elevational view of a golf cart according to the prior art.
Figure 2:
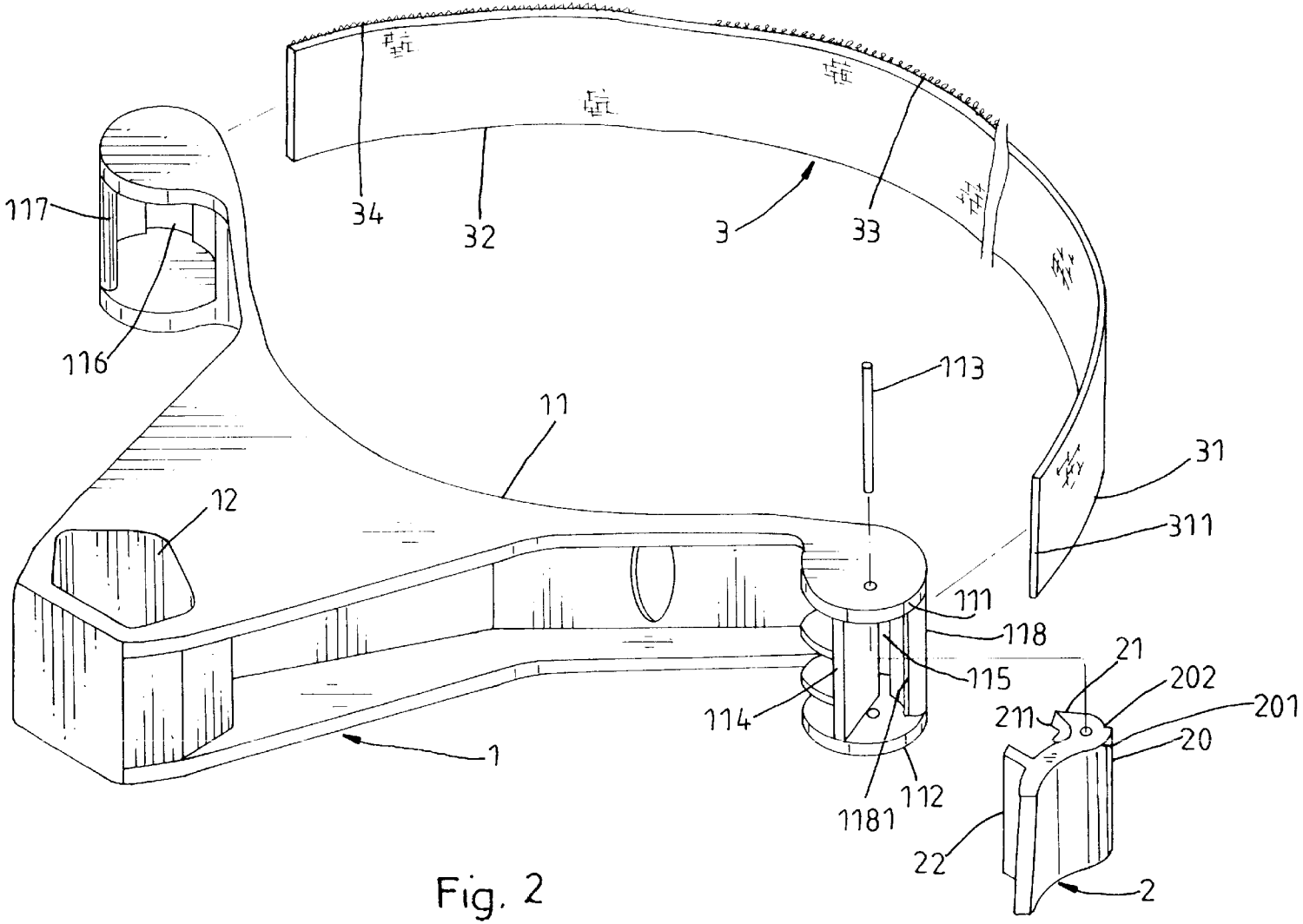
FIG. 2 is an exploded view of an upper golf bag cradle for a golf cart according to the present invention.
Figure 3:
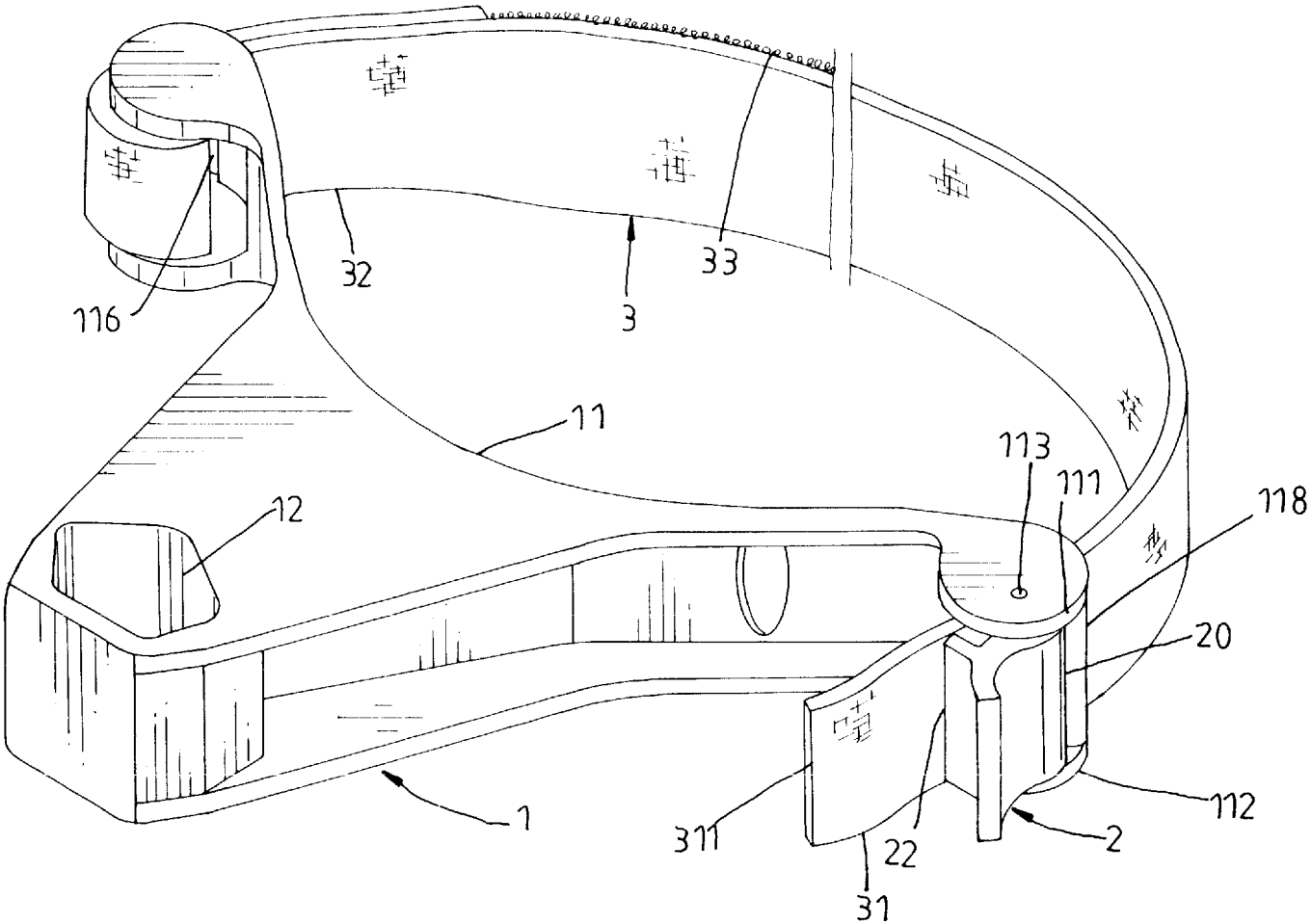
FIG. 3 is an assembly view of the upper golf bag cradle shown in FIG. 2.
Figure 4:
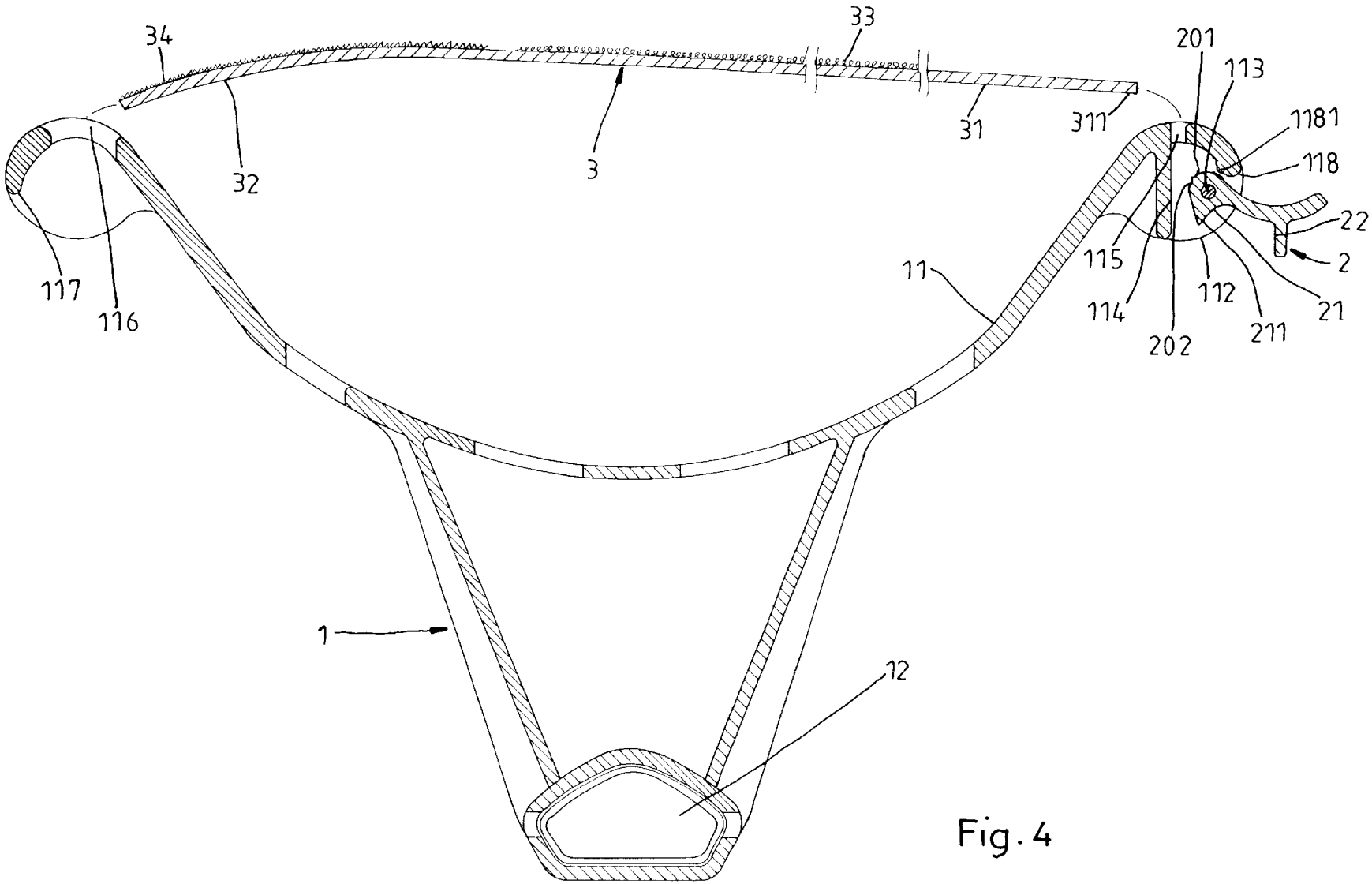
FIG. 4 is a sectional assembly view of the present invention, showing the locking lever turned to the unlocked position.
Figure 5:
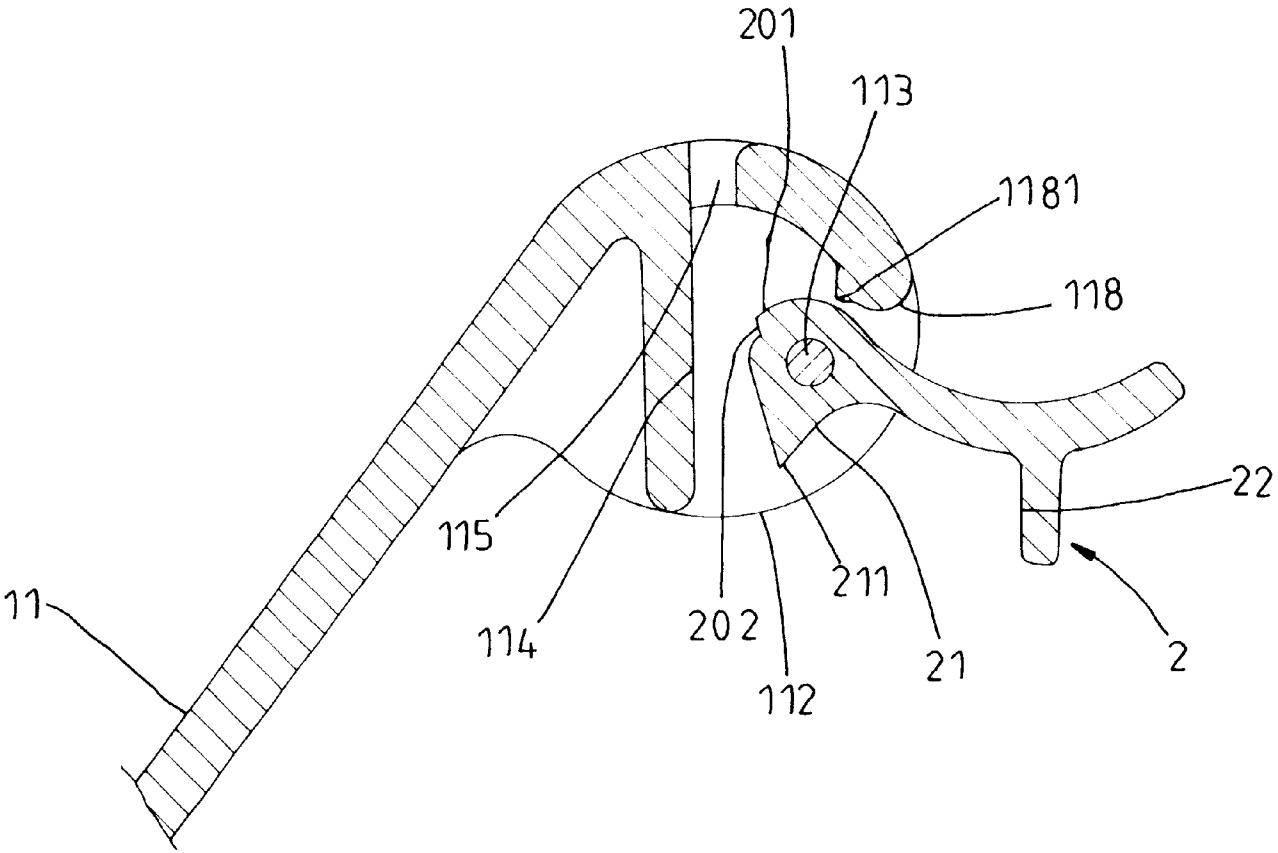
FIG. 5 is an enlarged view of a part of FIG. 4.

Referring to FIGS. from 4 through 7 again, before insertion of the first end 31 of the fastening belt 3, the locking lever 2 is turned about the pivot 113 in one direction to move the guide wall portion 201 and the protruded positioning flange 202 away from the first end plate 118, enabling the first end 31 of the fastening belt 3 to be smoothly inserted through the first insertion slot 115 to the desired distance (see FIGS. 4 and 5). After insertion of the first end 31 of the fastening belt 3 into first insertion slot 115, the locking lever 2 is turned about the pivot 113 in the reversed direction to move the guide wall portion 201 over the protruded flange 1181 of the first end plate 118 and to force the protruded positioning flange 202 into engagement with the protruded flange 1181 of the first end plate 118, and simultaneously to force the serrated portion 211 of the engagement block 21 into engagement with one side of the first end 31 of the fastening belt 3 against the support plate 114, keeping the first end 31 of the fastening belt 3 locked.

While only one embodiment of the present invention has been shown and described, it will be understood that various modifications and changes could be made thereunto without departing from the spirit and scope of the invention disclosed.

What is claimed is:

1. An upper golf bag cradle comprising a cradle body fixedly fastened to the main rod member of a golf cart and adapted to hold a golf bag, said cradle body having a front side wall, a back side wall, and two distal ends, and a fastening belt; said fastening belt having a first and a second end respectively fastened to the two distal ends of said cradle body and adapted to hold down a golf bag on said cradle body, wherein said cradle body comprises a first insertion slot and a second insertion slot respectively transversely disposed near the two distal ends thereof and adapted to receive the first end and second end of said fastening belt respectively, two parallel lugs integrally formed with front and back side walls thereof and disposed at two distal ends of said first insertion slot, a first end plate connected between said lugs at an outer side of said first insertion slot, a support plate connected between said lugs at an inner side of said first insertion slot opposite to said first end plate, a second end plate disposed at an outer side of said second insertion slot, a pivot connected between said lugs and spaced between said first end plate and said support plate; and a locking lever turned about said pivot between a locking position where said locking lever locks the first end of said fastening belt, and a second position where said locking lever unlocks the first end of said fastening belt for enabling said fastening belt to be disconnected from said first insertion slot; said locking lever comprising a head coupled to said pivot, and an engagement block raised from said head and adapted to hold down the first end of said fastening belt against said support plate, said engagement block comprising a serrated portion adapted to engage the first end of said fastening belt, and wherein said first end plate comprises a protruded flange transversely disposed at an inner side, and said locking lever comprises a guide wall portion adapted to guide the head of said locking lever over said first end plate upon rotary motion of said locking lever about said pivot, and a protruded positioning flange adapted for engagement with the protruded flange of said first end plate to hold said locking lever in the locking position.

2. The golf upper golf bag cradle of claim 1, wherein said locking lever further comprises an inwardly extended baffle adapted to guide detailed portion of the first end of said fastening belt toward said cradle body.

* * * * *